US007594323B2

(12) United States Patent
Chung et al.

(10) Patent No.: US 7,594,323 B2
(45) Date of Patent: Sep. 29, 2009

(54) METHODS FOR DESIGNING SINGLE-LOBE AND DOUBLE-LOBE ROTORS

(75) Inventors: Tien-Tung Chung, Taipei Hsien (TW); Heng-I Lin, Taipei Hsien (TW)

(73) Assignee: Liung Feng Industrial Co., Ltd., Taipei Hsien (TW)

( * ) Notice: Subject to any disclaimer, the term of this patent is extended or adjusted under 35 U.S.C. 154(b) by 779 days.

(21) Appl. No.: 11/350,819

(22) Filed: Feb. 10, 2006

(65) Prior Publication Data

US 2007/0050056 A1 Mar. 1, 2007

Related U.S. Application Data

(63) Continuation-in-part of application No. 11/214,876, filed on Aug. 31, 2005, now Pat. No. 7,255,545.

(30) Foreign Application Priority Data

Dec. 16, 2005 (TW) ..... 94144881 A

(51) Int. Cl.

| | |
|---|---|
| ***B21D 53/78*** | (2006.01) |
| ***F02B 53/04*** | (2006.01) |
| ***F01C 21/10*** | (2006.01) |
| ***F01C 1/16*** | (2006.01) |
| ***F01C 1/18*** | (2006.01) |
| ***G06F 17/50*** | (2006.01) |
| ***G06F 7/60*** | (2006.01) |

(52) U.S. Cl. ..... 29/889; 123/218; 418/150; 418/201.3; 418/206.5; 703/1; 703/2

(58) Field of Classification Search ..... 29/889; 123/200, 218; 418/150, 201.3, 206.5, 61.2; 703/1, 2

See application file for complete search history.

(56) References Cited

U.S. PATENT DOCUMENTS 6,776,594 B1 * 8/2004 Heng-I et al. ..... 418/206.5

* cited by examiner

*Primary Examiner*—David P Bryant
*Assistant Examiner*—Sarang Afzali
(74) *Attorney, Agent, or Firm*—Rosenberg, Klein & Lee

(57) ABSTRACT

The present invention provides methods for designing single-lobe or double-lobe rotors which enable a defined rotor and a conjugate rotor intermeshing and conjugating to each other and by parameterized sets to generate curve portions of half two lobes of the defined rotor including a curve E, an arc A, an arc B, an arc F, an arc C, an arc G and a horizontal line Y. The main feature is that a radius of the arc C being defined by following equation:

$$r_C = x + r_F = x\sin\beta + \frac{D}{2}$$

$$\Rightarrow x = \frac{(D/2) - r_F}{1 - \sin\beta};\quad r_C = \frac{(D/2) - r_F}{1 - \sin\beta} + r_F$$

in which $r_F$ is two times pitch circle radius(Rp) of the defined rotor deducting the maximum radius(R) of the defined rotor ($r_F$=2 Rp−R), and a center of the arc C is located in a straight extension direction from a center of the defined rotor and an end point of an arc F.

4 Claims, 6 Drawing Sheets

METHODS FOR DESIGNING SINGLE-LOBE AND DOUBLE-LOBE ROTORS

REFERENCE TO RELATED APPLICATIONS

This application is a continuation-in-part application of U.S. patent application Ser. No. 11/214,876 filed Aug. 31, 2005, now U.S. Pat. No. 7,255,545 the entire contents of the above mentioned application being incorporated herein by reference.

BACKGROUND OF THE INVENTION

1. Field of the Invention

The present invention relates to methods for designing single-lobe and double-lobe rotors. By parameterized sets, the methods can profile a defined rotor and a conjugate rotor with single lobe or double lobes which intermesh and conjugate to each other, and effectively evaluate optimum performance in intermeshing and conjugating, whereby to provide higher compression ratio and larger discharge capacity, secure a smooth process while working chamber undergoing compression and expansion, and reduce leakage, thus can reduce noise and vibration while operation of the rotors.

2. Related Art

A large variety of related rotor mechanism are already known, see for example U.S. Pat. Nos. 1,426,820, 4,138,848, 4,224,016, 4,324,538, 4,406,601, 4,430,050 and 5,149,256. Rotors of the prior arts have drawbacks that curves thereof are discontinuity and not smoothly at the joint between each segment and which cause tips of the rotors do not mesh completely with other rotor when they are rotating. Consequently, in applying to machines working as periodical expansion and compression operation, the abnormal situations such as noise and vibration take place in working chamber enclosed by defined rotor, conjugate rotor and inner walls of cylinder. Moreover, inappropriate intermeshing between the rotors increases wear and therefore reduces the durability of operation.

In view of aforesaid disadvantages, U.S. patent application Ser. No. 11/214,876 has disclosed a defined rotor and a conjugate rotor designed by variety of parameters. Such rotors can reduce noise and vibration as operation.

SUMMARY OF THE INVENTION

Accordingly, an object of the present invention is to provide methods for designing single-lobe and double-lobe rotors which is able to generate a defined rotor and a conjugate rotor intermeshing and conjugating to each other by different parameters. Moreover, the methods, as apply to machines working as periodical expansion and compression operation can provide higher compression ratio and larger discharge capacity, secure a smooth process while working chamber undergoing compression and expansion and which reduce leakage as well lessen noise and vibration while operation of the rotors.

To achieve the above-mentioned objects, the methods for designing single-lobe and double-lobe rotors of the present invention comprise: curve portions of half two lobes of the defined rotor including a curve E, an arc A, an arc B, an arc F, an arc C, an arc G and a line Y, wherein the center of the arc C is located in a straight extension direction of the line connected the center of the defined rotor and an end point of an arc F, and a radius of the arc C is defined by following equation:

$$r_C = x + r_F = x\sin\beta + \frac{D}{2}$$

$$\Rightarrow x = \frac{(D/2) - r_F}{1 - \sin\beta};\quad r_C = \frac{(D/2) - r_F}{1 - \sin\beta} + r_F$$

(in which $r_C$ is a radius of the arc C, x is a length between the center of the defined rotor and the center of the arc C, $r_F$ is a radius of the arc F, D is a width of the defined rotor)

By the above-mentioned methods, the curve portions of half two lobes of the defined rotor are formed and further symmetrically imaging the curve portions to form a defined rotor with two lobes.

In the manner of generating the curve portions of half two lobes of the defined rotor 1, further designating a symmetry point P8 which is symmetrical to the fourth point P4 against the first center t1, and which is located in an extension direction of a third line h3. A fourth center t4' located on the third line h3 and being symmetrical to the fourth center t4 against the first center t1, and defining an arc C' by drawing around the fourth center t4' with the radius $r_C$ from the symmetry point P8 to the sixth point P6; therefore the sixth point P6 of the arc C' is tangent to the horizontal line Y; further defining an arc G by drawing around the first center t1 with the radius $r_F$ from the fourth point P4 to the symmetry point P8, whereby the arc C' is smoothly linked with the horizontal line Y and the arc G; consequently, the single-lobe defined rotor is profiled by linking the curve E, the arc A, the arc B, the arc F, the arc C', the arc G and the horizontal line Y.

DESCRIPTION OF THE PREFERRED EMBODIMENTS

Figure 1:
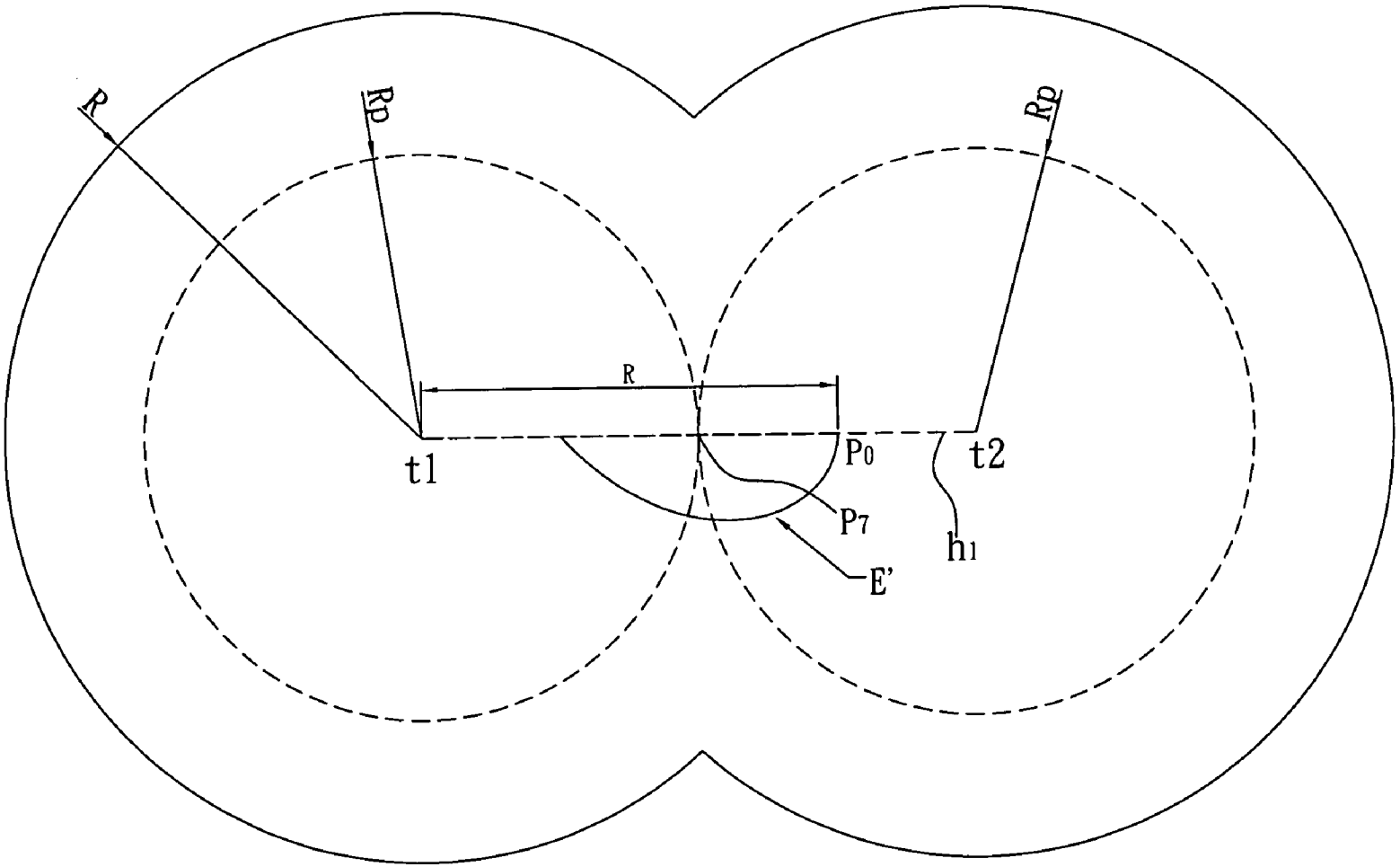
FIG. 1 is a schematic view of forming a tip conjugate curve by methods for designing single-lobe and double-lobe rotors of the present invention.
Figure 2:
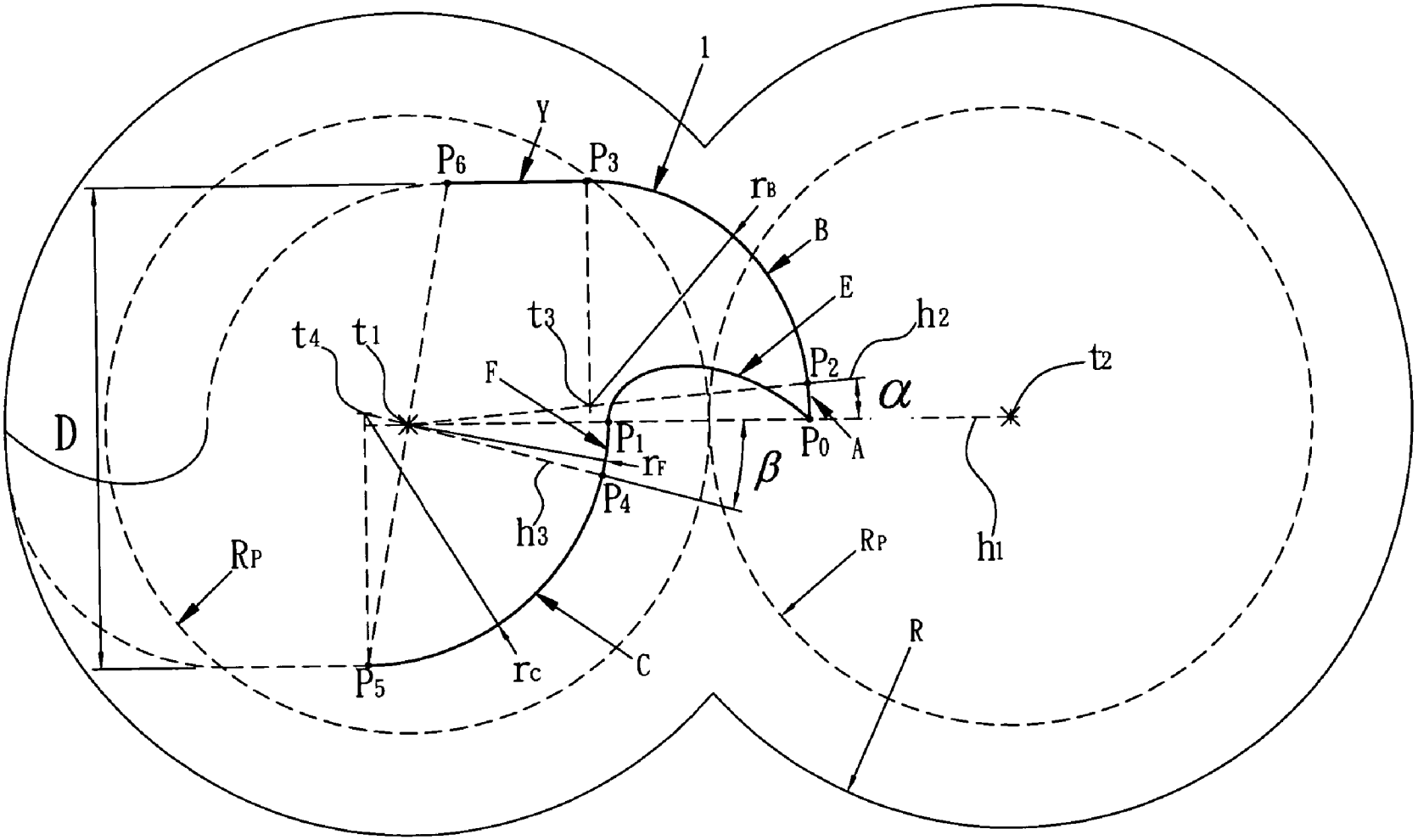
FIG. 2 is a schematic view of forming a double-lobe profile of a defined rotor by the methods of the present invention.
Figure 3:
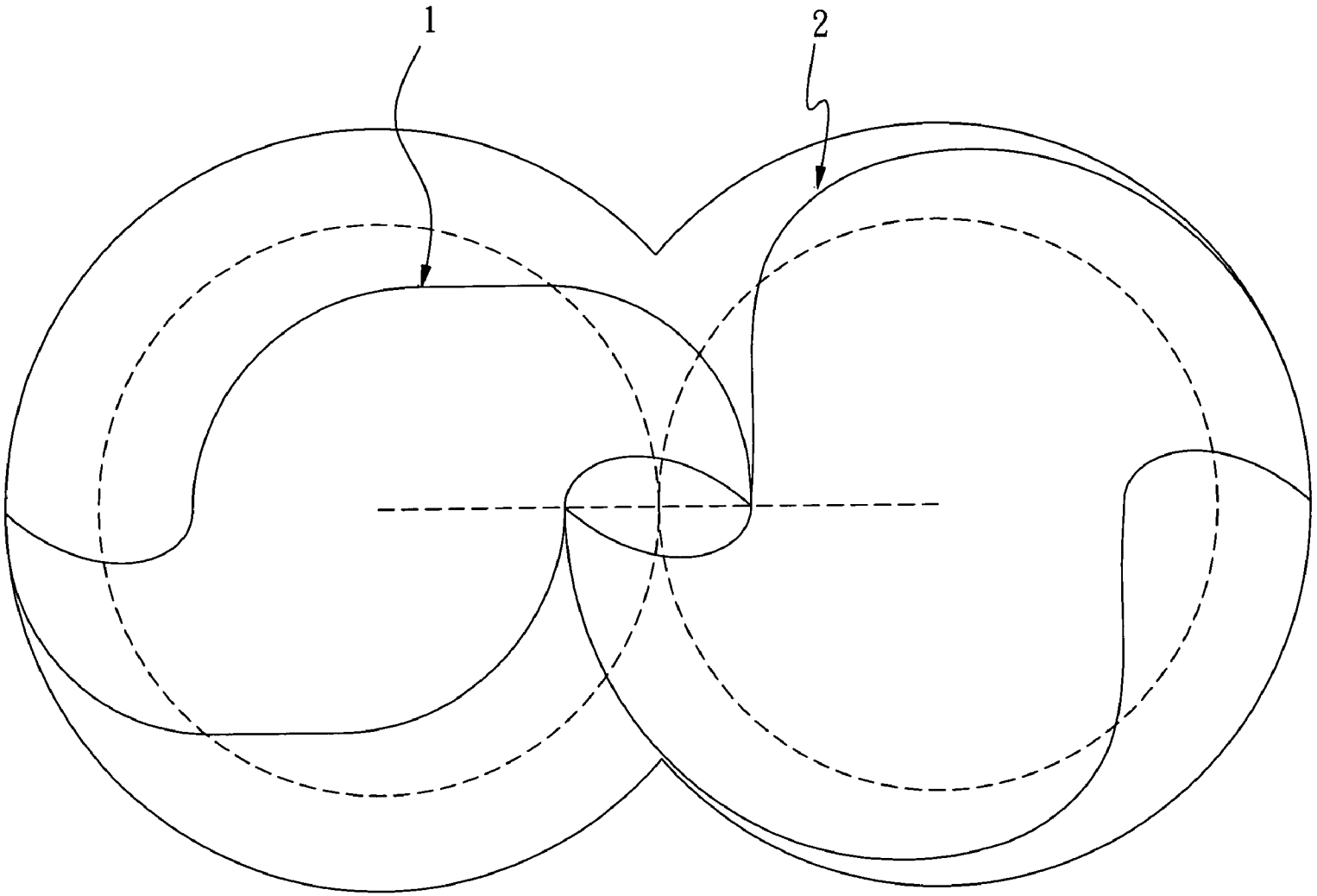
FIG. 3 is a schematic view of forming a double-lobe profile of a conjugate rotor by the methods of the present invention.

A double-lobe rotor design process in accordance with the present invention designs the curve portions of a defined rotor 1 by suitable parameters, and then get the curve portions of conjugate rotor 2 with conjugate theory. Referring to FIGS. 1 to 3, designing process for forming the curve portions of defined rotor 1 comprises the following steps:

1. Designate a maximum radius R and a width D of the defined rotor 1, a pitch circle radius Rp of the defined and the conjugate rotor 1, 2, a first center t1 of the defined rotor 1 and a second center t2 of the conjugate rotor 2, wherein a distance between the first center t1 and the second center t2 is 2 Rp, the pitch circle radius Rp is smaller than radius R, and R and Rp are in appropriate ratio R=4 Rp/3.

2. Referring to FIG. 1, define a reference horizontal line h1 by straight connecting the first center t1 and the second center t2, a base point P0 located on the reference horizontal line h1 and being offset from the first center t1 in a length same as the radius R, a conjugate curve E' generated as the base point P0 rotating around the first center t1, a curve E generated by symmetrically imaging the conjugate curve E' against a tangent point P7 of the two pitch circles of the defined and the conjugate rotor, and a first point P1 located in an intersection of the curve E and the horizontal line h1.
3. Referring to FIG. 2, designate a second point P2 which is formed by drawing around the first center t1 with the radius R from the point P0 in an central angle α (α is 5°), whereby an arc A is generated between the point P0 and P2, and is smoothly connected to the curve E.
4. Define a second line h2 by straight connecting the first center t1 and the second point P2 and further designating a third center t3 thereon, of which a radius is $r_B$.
5. The radius $r_B$ is defined by following equation:

$$r_B + (R - r_B)\sin\alpha = \frac{D}{2}$$

$$r_B = \frac{D/2 - R\sin\alpha}{1 - \sin\alpha}$$

(wherein R=the maximum radius of the defined rotor 1, that is, a length between the first center t1 and the second point P2)

6. Define an arc B by drawing around the third center t3 with the radius $r_B$ from the second point P2 to a third point P3, wherein the third point P3 is vertically located above the third center t3.
7. Define an arc F by drawing around the first center t1 with a radius $r_F$ from a first point P1 to a fourth point P4 wherein the fourth point P4 is designated by an central angle β (β is 15°) measured downward from the first point P1 according to the first center t1, and the radius $r_F$ is defined by following equation $r_F$=2 Rp−R.
8. Prior to generating an arc C, define a third line h3 which is an extension line with the direction of straight connecting the fourth point P4 and the first center t1, and further designate a fourth center t4 being located in the third line h3.
9. Defining an arc C by drawing around the fourth center t4 with a radius $r_C$ from the fourth point P4 to a fifth point P5, wherein the fifth point P5 is vertically located under the fourth center t4, and the radius $r_C$ is defined by following equation:

$$r_C = x + r_F = x\sin\beta + \frac{D}{2}$$

$$\Rightarrow x = \frac{(D/2) - r_F}{1 - \sin\beta};\quad r_C = \frac{(D/2) - r_F}{1 - \sin\beta} + r_F$$

in which $r_F$=2 Rp−R.

10. Define a horizontal line Y by connecting the third point P3 and a sixth point P6 which is symmetrical to the fifth point P5; whereby curve portions of half two lobes of the defined rotor 1 are generated by smooth linking the curve E, the arc A, arc B, arc F, arc C, and the horizontal line Y. And further symmetrically imaging each arc and curve of half two lobes of the defined rotor 1 to form the complete defined rotor 1 with doublelobes.
11. Furthermore, the conjugate rotor 2 is formed by way of aforesaid curve portions of the defined rotor 1 and through a conjugate curve profiled respectively from each arc and curve of the double-lobe of the defined rotor 1 by the above-described steps, the double-lobe defined rotor 1 and the conjugate rotor 2 are formed accordingly.

Figure 4:
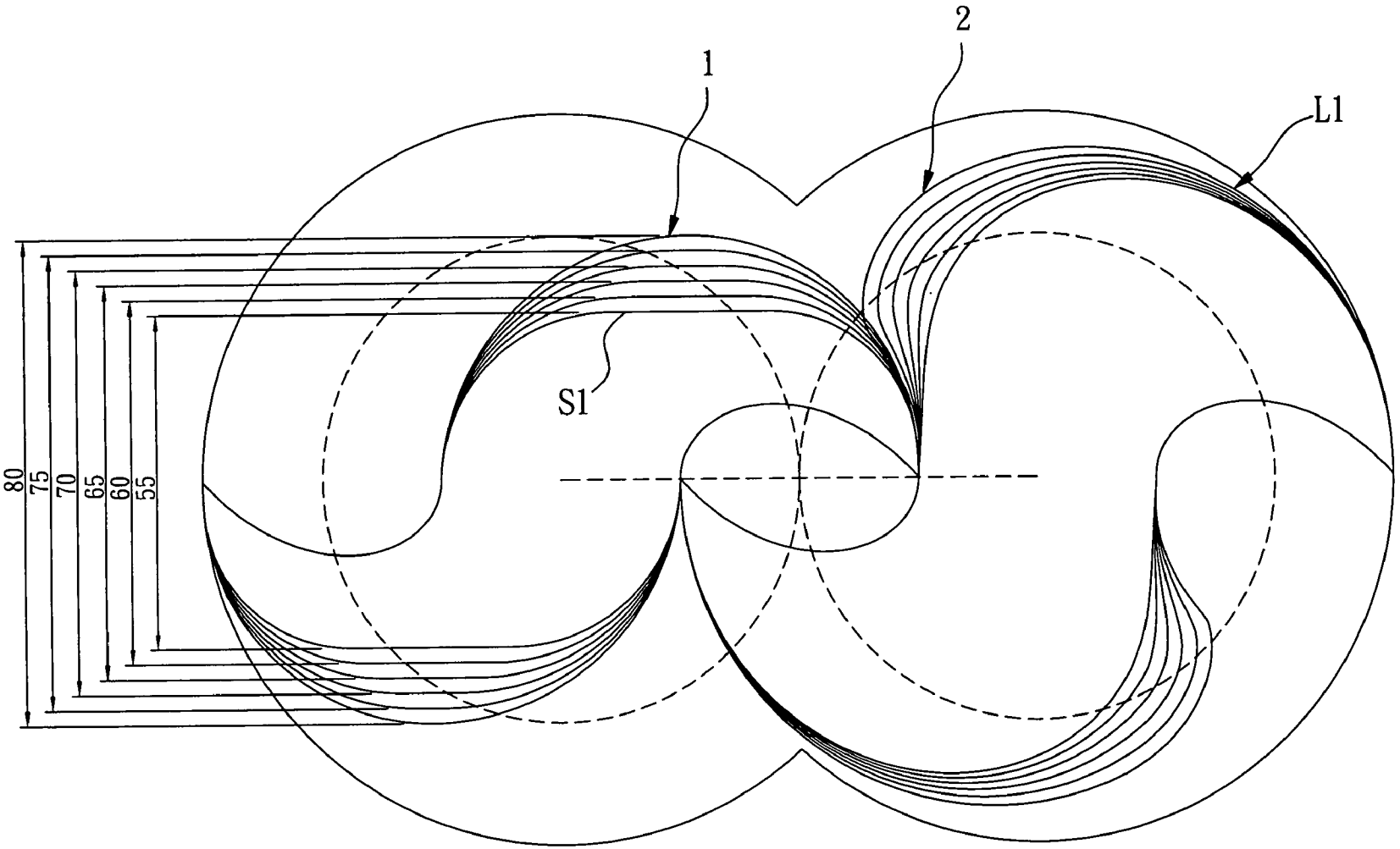
FIG. 4 is a schematic view of various combinations of the double-lobe defined rotor and conjugate rotor, wherein a width D thereof is 55, 60 . . . 80 mm, a central angle $\alpha$ is 5° and a central angel $\beta$ is 5°.

Further referring to FIG. 4, which is a schematic view of various combinations of the double-lobe defined rotor and conjugate rotor, wherein a width D thereof is 55, 60 . . . 80 mm, a central angle α is 5° and a central angel β is 5°; as general characteristics of conjugate intermeshing between two rotors, the defined rotor 1 (S1) of the minimum width D corresponds to the conjugate rotor 2 (L1) of the maximum value. Accordingly, depending on practical applications, an appropriate size of the defined rotor 1 and the conjugate rotor 2 can be determined by analogy with aforesaid characteristics.

Figure 5:
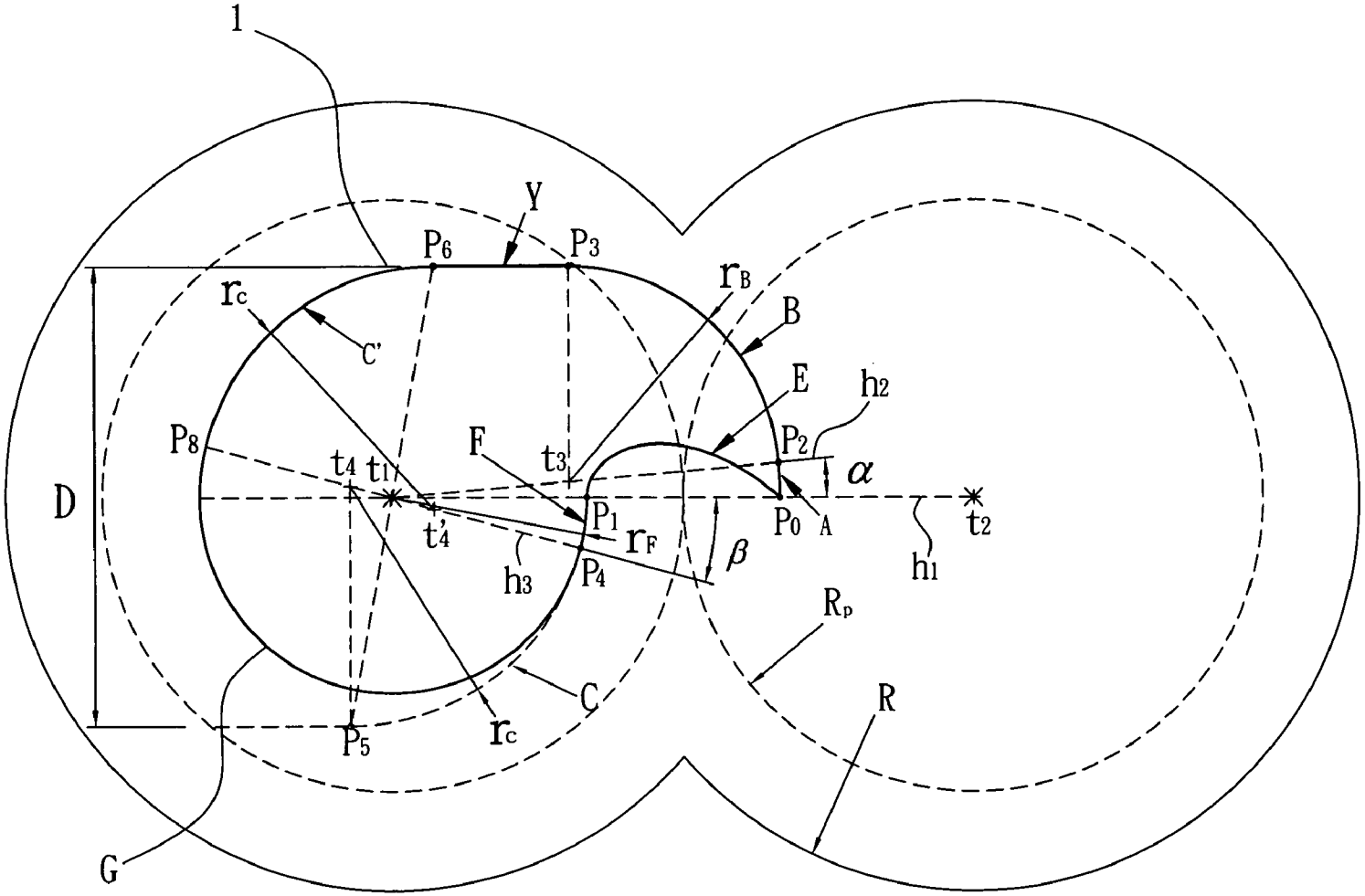
FIG. 5 is a schematic view of forming a single-lobe profile of a defined rotor by the methods of the present invention.
Figure 6:
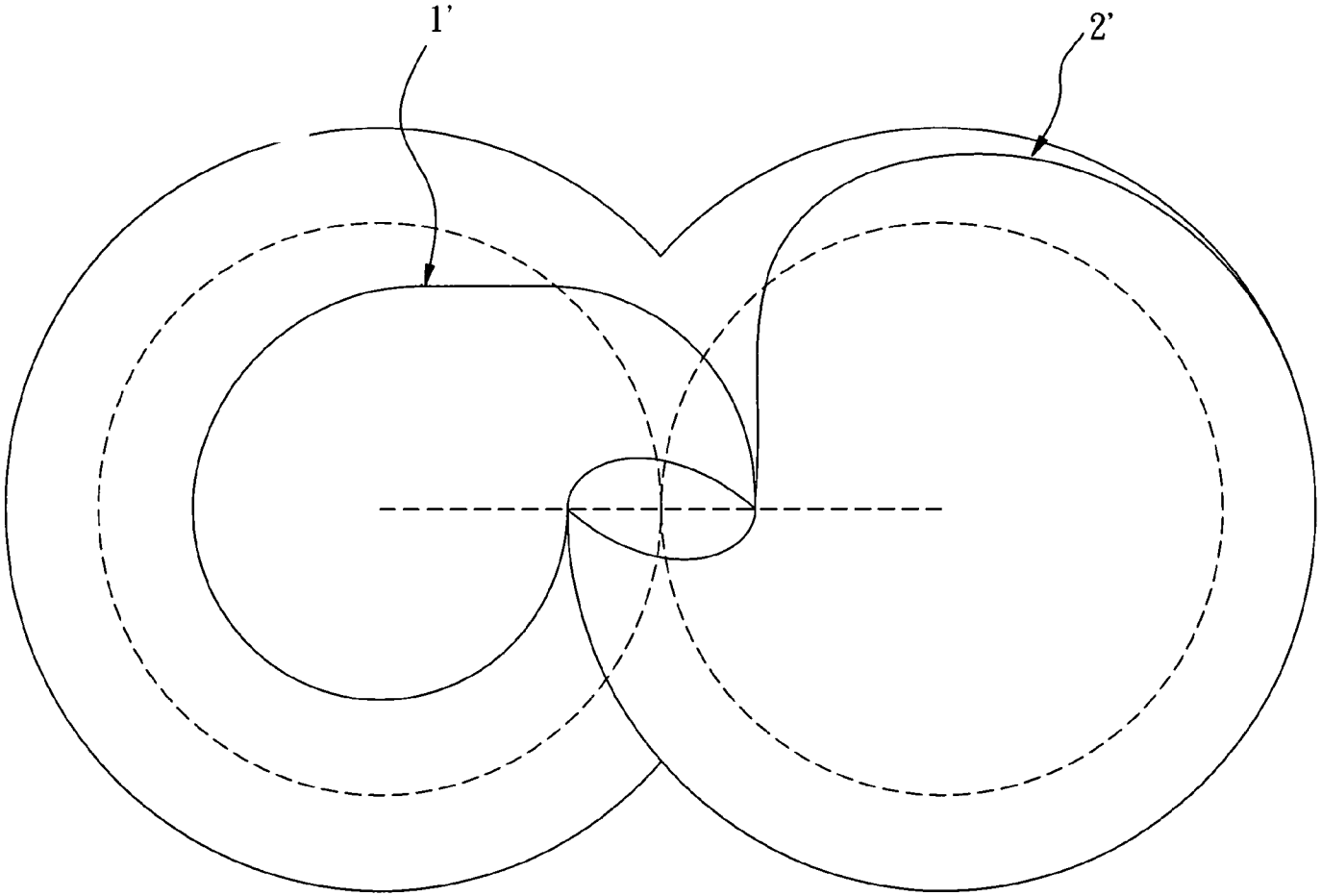
FIG. 6 is a schematic view of forming a single-lobe profile of a conjugate rotor by the methods of the present invention.

Moreover, referring to FIG. 5 for methods for generating curve portions of the single-lobe defined rotor 1'; in the manner of generating the curve portions of half two lobes of the defined rotor 1, that is, bold parts shown in FIG. 2. Further designating a symmetry point P8 which is symmetrical to the fourth point P4 against the first center t1, and which is located in an extension direction of a third line h3. A fourth center t4' located on the third line h3 and being symmetrical to the fourth center t4 against the first center t1, and defining an arc C' by drawing around the fourth center t4' with the radius $r_C$ from the symmetry point P8 to the sixth point P6; therefore the sixth point P6 of the arc C' is tangent to the horizontal line Y; further defining an arc G by drawing around the first center t1 with the radius $r_F$ from the fourth point P4 to the symmetry point P8, whereby the arc C' is smoothly linked with the horizontal line Y and the arc G; consequently, the single-lobe defined rotor 1' is profiled by linking the curve E, arc A, arc B, arc F, arc C', arc G and horizontal line Y The single-lobe conjugate rotor 2' is formed (shown in FIG. 6) by way of aforesaid curve portions and through the conjugate curve profiled respectively from each arc and curve of the single-lobe of the defined rotor 1 by the above-described steps.

By parameterized sets, the methods can profile a single-lobe or double-lobe of a defined rotor and a conjugate rotor which intermesh and conjugate to each other, and effectively evaluate optimum performance in intermeshing and conjugating, whereby to provide higher compression ratio and larger discharge capacity, secure a smooth process while working chamber undergoing compression and expansion, and which reduce leakage, thus lessen noise and vibration while operation of the rotors. Besides, the conjugate curve portions of the conjugate rotor 2 relatively profiled through the arc F and arc G of the defined rotor 1 are still arcs, could effectively enhance the sealing ability further.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A method for designing single-lobe or double-lobe rotors which enable a defined rotor and a conjugate rotor intermeshing and conjugating to each other and by parameterized sets to generate curve portions of half two lobes of the defined rotor including a curve E, an arc A, an arc B, an arc F, an arc C, an arc G and a line Y, and further symmetrically imaging the curve portions to form the defined rotor with single-lobe or double-lobe, a conjugate rotor with single-lobe or double-lobe which is formed through a conjugate curve that profiled respectively by each arc and curve of the single-lobe or double-lobe of the defined rotor, wherein a method of the curve portions of half two lobes of the defined rotor comprising:

designating a maximum radius R of the defined rotor and a width D of the defined rotor, a pitch circle radius Rp of the defined rotor and the conjugate rotor, a first center t1 of the defined rotor and a second center t2 of the conjugate rotor, wherein a distance between the first center t1 and the second center t2 is 2 Rp, the pitch circle radius Rp is smaller than radius R, and R and Rp are in appropriate ratio in length;

defining a reference horizontal line h1 by straight connecting the first center t1 and the second center t2, a base point P0 located on the reference horizontal line h1 and being offset from the first center t1 in a length same as the radius R, a conjugate curve E' generated as the base point P0 rotating around the first center t1, a curve E generated by symmetrically imaging the conjugate curve E' against a tangent point P7 of the two pitch circles of the defined rotor and the conjugate rotor, a first point P1 located in an intersection of the curve E and the horizontal line h1;

designating a second point P2 being formed by drawing around the first center t1 with the radius R from the point P0 in a central angle α, an arc A generated by connecting the point P0 and P2, and smoothly connected to the curve E;

defining a second line h2 by straight connecting the first center t1 and the second point P2, and further designating a third center t3 thereon and a radius $r_B$ wherein the radius $r_B$ being defined by following equation:

$$r_B + (R - r_B)\sin\alpha = \frac{D}{2}$$

$$r_B = \frac{D/2 - R\sin\alpha}{1 - \sin\alpha}$$

defining an arc B by drawing around the second center t2 with the radius $r_B$ from the second point P2 to a third point P3, wherein the third point P3 being vertically located above the second center t2;

defining an arc F by drawing around the first center t1 with a radius $r_F$ from the first point P1 to a fourth point P4 wherein the fourth point P4 being designated by an central angle β measured downward from the first point P1 according to the first center t1, and the radius $r_F$ being defined by following equation $r_F$=2 Rp−R;

defining a third line h3 which is an extension line with the direction of straight connecting the fourth point P4 and the first center t1, where a fourth center t4 being located in the third line h3;

defining an arc C by drawing around the fourth center t4 with a radius $r_C$ from the fourth point P4 to a fifth point P5 which is vertically located under the fourth center t4, wherein the radius $r_C$ being defined by following equation:

$$r_C = x + r_F = x\sin\beta + \frac{D}{2}$$

$$\Rightarrow x = \frac{(D/2) - r_F}{1 - \sin\beta};\quad r_C = \frac{(D/2) - r_F}{1 - \sin\beta} + r_F$$

in which $r_F$=2 Rp−R;

defining a horizontal line Y by connecting the third point P3 and a sixth point P6 which is symmetrical to the fifth point P5; whereby curve portions of half two lobes of the defined rotor being generated by linking the curve E, the arc A, the arc B, the arc F, the arc C, and the horizontal line Y; and forming the single-lobe or double-lobe rotor in accordance with the generated curve portions of the half two lobes.

2. The method for designing single-lobe or double-lobe rotors as claimed in claim 1, wherein generating curve portions of the single-lobe rotor comprises: designating a symmetry point P8 which is symmetrical to the fourth point P4 against the first center t1, and which is located in an extension direction of a third line h3, a fourth center t4' located on the third line h3 and being symmetrical to the fourth center t4 against the first center t1, and defining a arc C' by drawing around the fourth center t4' with the radius $r_C$ from the symmetry point P8 to the sixth point P6; therefore the sixth point P6 of the arc C' is tangent to the horizontal line Y; further defining an arc G by drawing around the first center t1 with the radius $r_F$ from the fourth point P4 to the symmetry point P8, whereby the arc C' is smoothly linked with the horizontal line Y and the arc G; consequently, the single-lobe rotor is profiled by linking the curve E, arc A, arc B, arc F, arc C', arc G and horizontal line Y.

3. The method for designing single-lobe or double-lobe rotors as claimed in claim 1, wherein the curve portions of half two lobes of the defined rotor are formed and further symmetrically imaging the curve portions to form a defined rotor with two lobes.

4. The method for designing single-lobe or double-lobe rotors as claimed in claim 1, wherein the maximum radius R of the defined rotor and the pitch circle radius Rp are in a ratio R=4 Rp/3.

* * * * *